US009277782B2

(12) United States Patent
Coe

(10) Patent No.: US 9,277,782 B2
(45) Date of Patent: Mar. 8, 2016

(54) SHOE LOCATING SYSTEM

(71) Applicant: Tracy A. Coe, McKinney, TX (US)

(72) Inventor: Tracy A. Coe, McKinney, TX (US)

( * ) Notice: Subject to any disclaimer, the term of this patent is extended or adjusted under 35 U.S.C. 154(b) by 93 days.

(21) Appl. No.: 14/247,446

(22) Filed: Apr. 8, 2014

(65) Prior Publication Data

US 2015/0282552 A1 Oct. 8, 2015

(51) Int. Cl.

| | |
|---|---|
| ***G08B 19/00*** | (2006.01) |
| ***A43B 3/00*** | (2006.01) |
| ***G08B 13/14*** | (2006.01) |
| ***G08B 21/24*** | (2006.01) |

(52) U.S. Cl.

CPC ..... *A43B 3/0005* (2013.01); *G08B 13/1427* (2013.01); *G08B 21/24* (2013.01)

(58) Field of Classification Search

None

See application file for complete search history.

(56) References Cited

U.S. PATENT DOCUMENTS

| | | | | |
|---|---|---|---|---|
| 5,452,269 | A | 9/1995 | Cherdak | |
| 6,819,258 | B1 | 11/2004 | Brown | |
| 7,178,929 | B2 | 2/2007 | Guzman | |
| D554,848 | S | 11/2007 | Marston | |
| 7,714,709 | B1 | 5/2010 | Daniel | |
| 8,154,403 | B1 * | 4/2012 | Pienkos | A45C 13/18 340/539.11 |
| 8,289,156 | B2 | 10/2012 | Bertagna et al. | |
| 2011/0094127 | A1 | 4/2011 | Dana, III | |
| 2014/0225740 | A1 * | 8/2014 | Hochman | G08B 13/1427 340/686.6 |

FOREIGN PATENT DOCUMENTS

| | | |
|---|---|---|
| KR | 1020130073648 A | 7/2013 |
| WO | WO2012059269 | 10/2012 |

* cited by examiner

*Primary Examiner* — Ojiako Nwugo

(57) ABSTRACT

A shoe locating system locates a missing match of a pair of shoes. The system includes a left shoe processor unit and a left shoe transceiver each coupled to a left shoe. The left shoe transceiver is communicatively coupled to the left shoe processor unit. A right shoe processor unit and a right shoe transceiver each is coupled to a right shoe. The right shoe transceiver is communicatively coupled to the right shoe processor unit and the left shoe transceiver. A left shoe signal assembly communicatively coupled to the left shoe processor unit produces a left shoe alert signal when the left shoe transceiver receives a left shoe tracking signal from the right shoe transceiver. A right shoe signal assembly communicatively coupled to the right shoe processor unit produces a right shoe alert signal when the right shoe transceiver receives a right shoe tracking signal from the left shoe transceiver.

8 Claims, 4 Drawing Sheets

SHOE LOCATING SYSTEM

BACKGROUND OF THE DISCLOSURE

Field of the Disclosure

The disclosure relates to shoe devices and more particularly pertains to a new shoe device for locating a missing match of a pair of shoes.

SUMMARY OF THE DISCLOSURE

An embodiment of the disclosure meets the needs presented above by generally comprising a left shoe. A left shoe housing, a left shoe processor and a left shoe transceiver each is coupled to the left shoe. The left shoe transceiver is communicatively coupled to the left shoe processor unit. A right shoe housing, a right shoe processor unit and a right shoe transceiver is each coupled to a right shoe. The right shoe transceiver is communicatively coupled to the right shoe processor unit and the left shoe transceiver. A left shoe signal assembly is communicatively coupled to the left shoe processor unit for producing a left shoe alert signal when the left shoe transceiver receives a left shoe tracking signal from the right shoe transceiver. A right shoe signal assembly is communicatively coupled to the right shoe processor unit for producing a right shoe alert signal when the right shoe transceiver receives a right shoe tracking signal from the left shoe transceiver.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
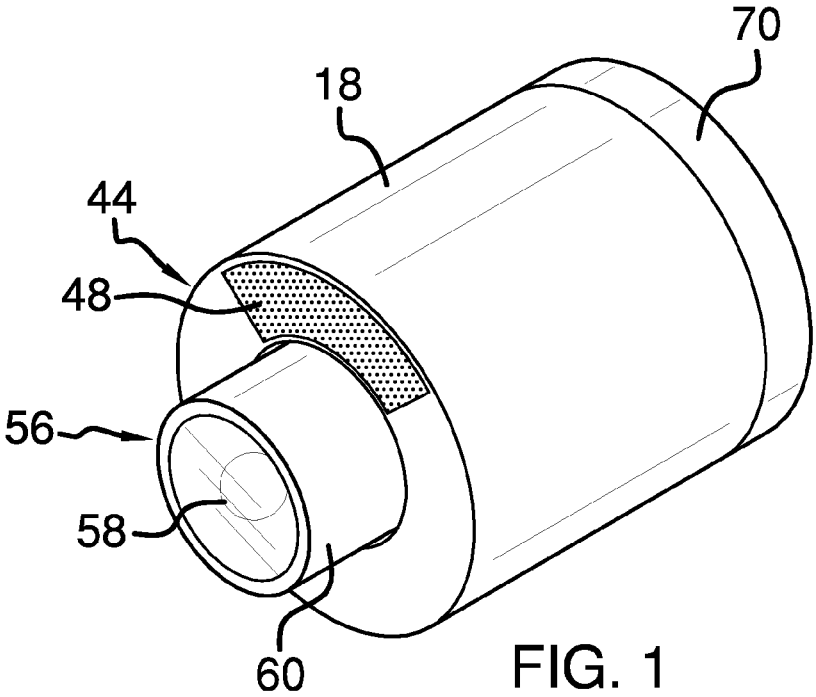
FIG. 1 is a top front side perspective view of a shoe locating system according to an embodiment of the disclosure.
Figure 2:
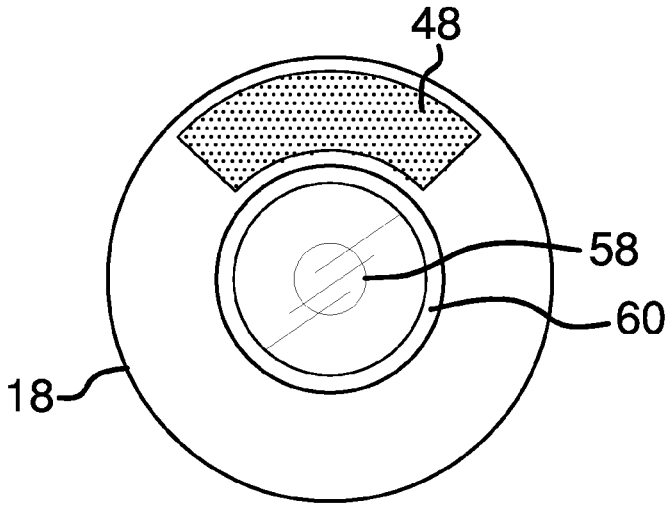
FIG. 2 is a front view of an embodiment of the disclosure.
Figure 3:
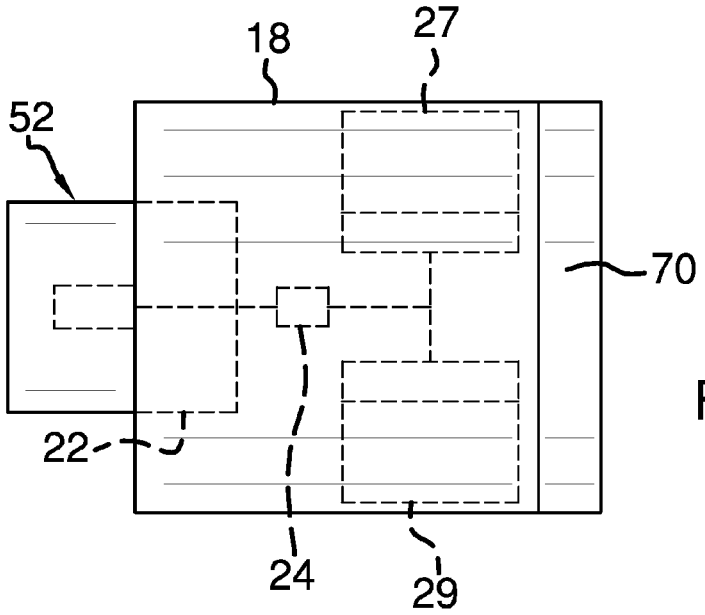
FIG. 3 is a side view of an embodiment of the disclosure.
Figure 4:
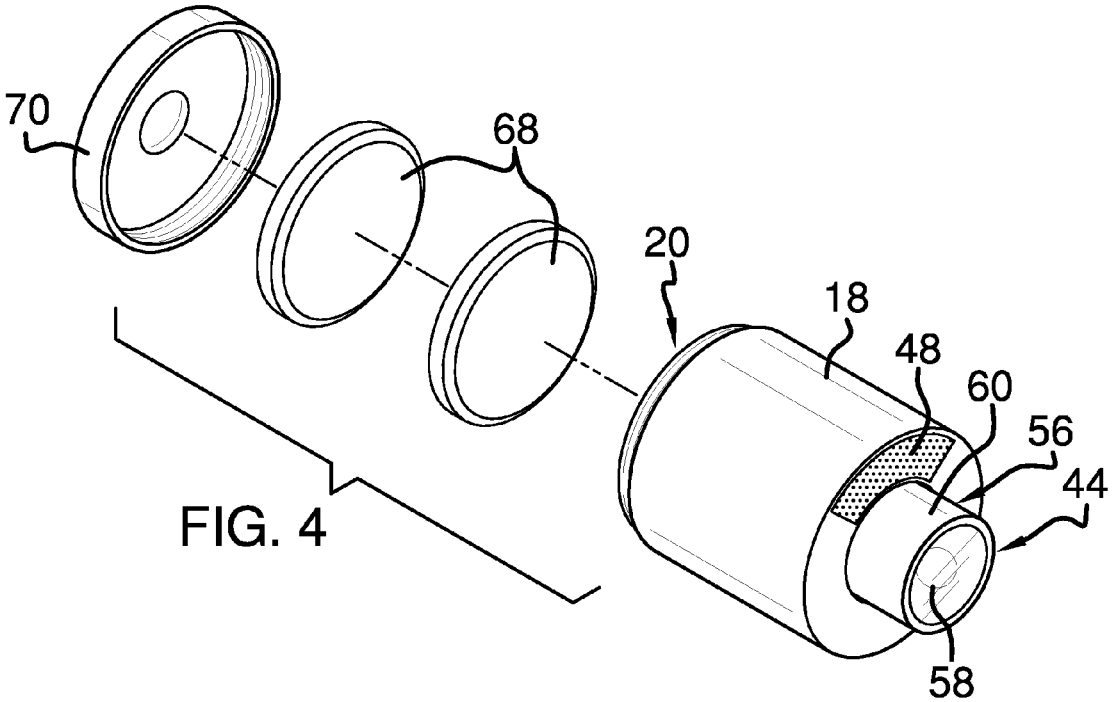
FIG. 4 is an exploded top front side perspective view of an embodiment of the disclosure.
Figure 5:
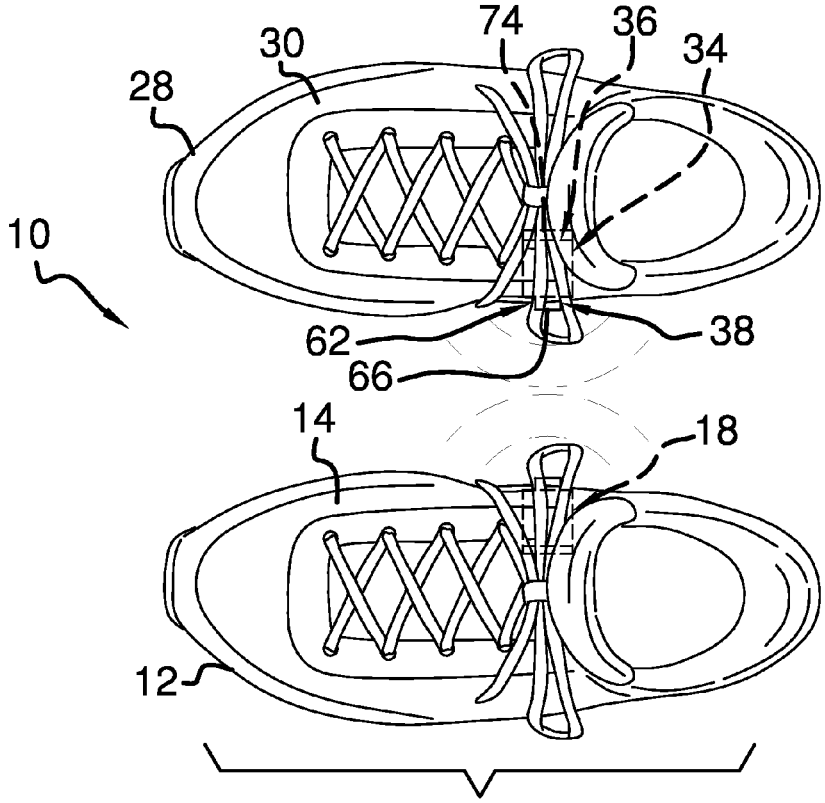
FIG. 5 is a top view of an embodiment of the disclosure in use.
Figure 6:
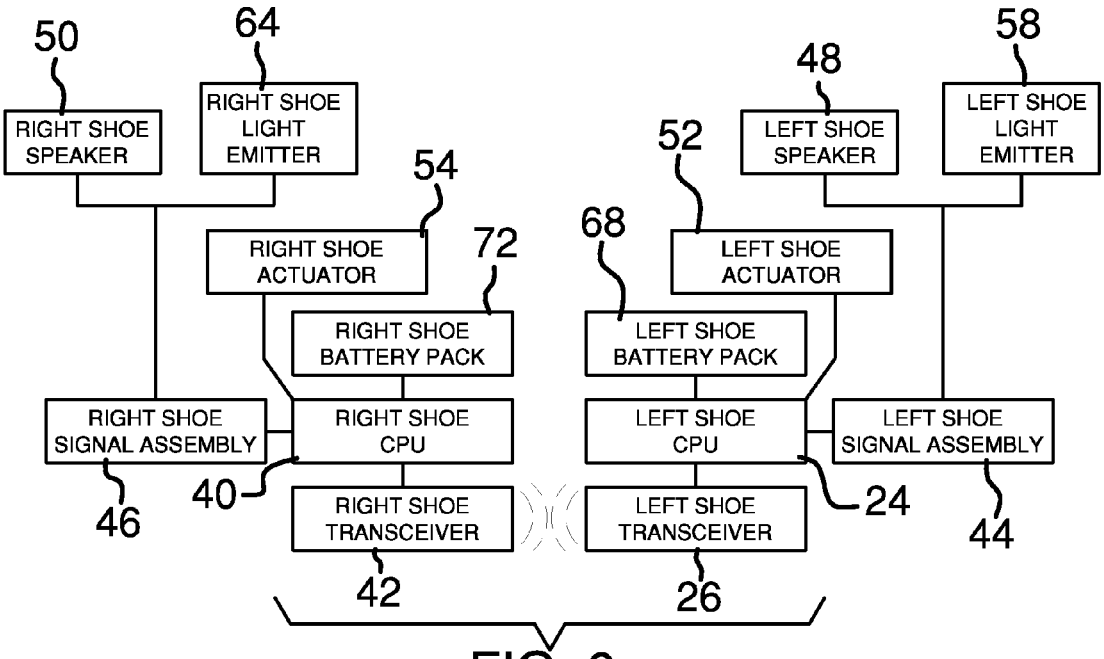
FIG. 6 is a schematic view of an embodiment of the disclosure.
Figure 7:
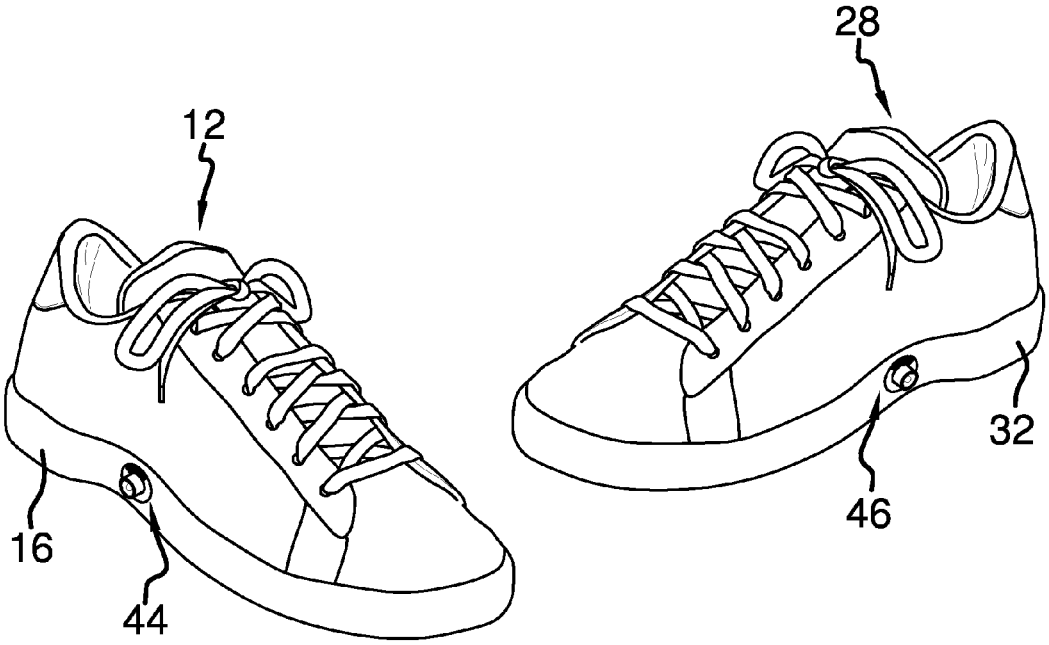
FIG. 7 is a side perspective view of an embodiment of the disclosure in use.

With reference now to the drawings, and in particular to FIGS. 1 through 7 thereof, a new shoe device embodying the principles and concepts of an embodiment of the disclosure and generally designated by the reference numeral 10 will be described.

As best illustrated in FIGS. 1 through 7, the shoe locating system 10 generally comprises a left shoe 12 having a left shoe upper body 14 coupled to a left shoe outsole 16. A left shoe housing 18 is coupled to and positioned in the left shoe 12. The left shoe housing 18 may be comprised of a rigid material, such as plastic or the like. The left shoe housing 18 has an opening 20 positioned therein providing access to an interior of the left shoe housing 18. The left shoe housing 18 may also have a slot 22 extending therein. A left shoe processor unit 24 is coupled to the left shoe housing 18. A left shoe transceiver 26 is coupled to the left shoe housing 18 and includes a left shoe transmitter 27 and a left shoe receiver 29. The left shoe transceiver 26 is communicatively coupled to the left shoe processor unit 24.

A right shoe 28 has a right shoe upper body 30 coupled to a right shoe outsole 32. A right shoe housing 34 is coupled to and positioned in the right shoe 28. The right shoe housing 34 is identical to the left shoe housing 18 and thus may also be constructed from a rigid material, such as plastic or the like. The right shoe housing 34 has an aperture 36 positioned therein providing access to an interior of the right shoe housing 34. The aperture 36 is the right shoe 28 equivalent of the left shoe 12 opening 20. The right shoe housing 34 may also have a void 38 extending therein. The void 38 is the right shoe 28 equivalent of the left shoe 12 slot 22. A right shoe processor unit 40 is coupled to the right shoe housing 34. A right shoe transceiver 42 is coupled to the right shoe housing 34 and is communicatively coupled to the right shoe processor unit 40 and the left shoe transceiver 26.

A left shoe signal assembly 44 is communicatively coupled to the left shoe processor unit 24 for producing a left shoe alert signal when the left shoe transceiver 26 receives a left shoe tracking signal from the right shoe transceiver 42. Similarly, a right shoe signal assembly 46 is communicatively coupled to the right shoe processor unit 40 for producing a right shoe alert signal when the right shoe transceiver 42 receives a right shoe tracking signal from the left shoe transceiver 26.

The left shoe signal assembly 44 may include a left shoe speaker 48 coupled to the left shoe housing 18. The left shoe speaker 48 produces a left shoe audio signal when the left shoe transceiver 26 receives the left shoe tracking signal from the right shoe transceiver 42. Similarly, the right shoe signal assembly 46 may include a right shoe speaker 50 coupled to the right shoe housing 34. The right shoe speaker 50 produces a right shoe audio signal when the right shoe transceiver 42 receives the right shoe tracking signal from the left shoe transceiver 26.

A left shoe actuator 52 is provided and may be coupled to the left shoe housing 18. The left shoe actuator 52 is communicatively coupled to the left shoe processor unit 24 wherein the right shoe transceiver 42 receives the right shoe alert signal from the left shoe transceiver 26 upon activation of the left shoe actuator 52. Similarly, a right shoe actuator 54 is provided and may be coupled to the right shoe housing 34. The right shoe actuator 54 is communicatively coupled to the right shoe processor unit 40 wherein the left shoe transceiver 26 receives the left shoe alert signal from the right shoe transceiver 42 upon activation of the right shoe actuator 54.

The left shoe signal assembly 44 may include a left shoe light assembly 56. The left shoe light assembly 56 may include a left shoe light emitter 58 and a left cover 60. The left shoe light emitter 58 is coupled to the left shoe housing 18. The left shoe light emitter 58 is electrically coupled to the left shoe processor unit 24 to illuminate the left shoe light emitter 58 when the left shoe transceiver 26 receives the left shoe tracking signal from the right shoe transceiver 42. The left shoe light emitter 58 may project outwardly from the left shoe housing 18. The left cover 60 extends around the left shoe light emitter 58. The left shoe light assembly 56 may be extendable into the slot 22 whereby the left shoe light assembly 56 defines the left shoe actuator 52. Alternatively, the left shoe actuator 52 and the left shoe light assembly 56 may be separate and distinct. The left shoe housing 18 may be coupled to the left shoe outsole 16 such that the left shoe light assembly 56 projects outwardly from the left shoe outsole 16.

Similarly, the right shoe signal assembly 46 may include a right shoe light assembly 62. The right shoe light assembly 62 may include a right shoe light emitter 64 and a right cover 66. The right shoe light emitter 64 is coupled to the right shoe housing 34. The right shoe light emitter 64 is electrically coupled to the right shoe processor unit 40 to illuminate the right shoe light emitter 64 when the right shoe transceiver 42 receives the right shoe tracking signal from the left shoe transceiver 26. The rights shoe light emitter 64 may project outwardly from the right shoe housing 34. The right cover 66 extends around the right shoe light emitter 64. The right shoe light assembly 62 may be extendable into the void 38 whereby the right shoe light assembly 62 defines the right shoe actuator 54. Alternatively, the right shoe light assembly 62 and the right shoe actuator 54 may be separate and distinct. The right shoe housing 34 may be coupled to the right shoe outsole 32 such that the right shoe light assembly 62 projects outwardly from the right shoe outsole 32.

A left shoe battery 68 may be electrically coupled to the left shoe processor unit 24 for providing power to the left shoe processor unit 24. The left shoe battery 68 is positionable in the interior of the left shoe housing 18 through the opening 20. The left shoe battery 68 may be one of a plurality of left shoe batteries 68, each of which may be rechargeable. A left shoe lid 70 is couplable to the left shoe housing 18 and is positionable to cover the opening 20 into the left shoe housing 18. The left shoe lid 70 may threadably engage the left shoe housing 18. Similarly, a right shoe battery 72 may be electrically coupled to the right shoe processor unit 40 for providing power to the right shoe processor unit 40. The right shoe battery 72 is positionable in the interior of the right shoe housing 34 through the aperture 36. The right shoe battery 72 may be one of a plurality of right shoe batteries 72, each of which may be rechargeable. A right shoe lid 74 is couplable to the right shoe housing 34 and is positionable to cover the aperture 36 into the right shoe housing 34. The right shoe lid 74 may threadably engage the right shoe housing 34 in the same manner as the left shoe lid 70 does with the left shoe housing 18.

In use, the right shoe housing 34 is coupled to the right shoe 28 and the left shoe housing 18 is coupled to the left shoe 12. In the event that the left shoe 12 cannot be located, the right shoe actuator 54 is manipulated to cause the left shoe light emitter 64 to illuminate and the left shoe speaker 48 to produce the left shoe audio signal. In the event that the right shoe 28 cannot be located, the left shoe actuator 52 is manipulated to cause the right shoe light emitter 64 to illuminate and the right shoe speaker 50 to produce the right shoe audio signal. In this manner, the system 10 will facilitate finding a missing match of a pair of shoes 12, 28. Alternatively, an independent remote may be communicatively coupled to each of the right shoe processor unit 40 and the left shoe processor unit 24 in order to facilitate finding either or both of the left 12 and right 28 shoes of a pair of shoes. The independent remote is particularly useful when neither shoe 12, 28 can be located.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe locating system comprising:

a left shoe;

a left shoe housing coupled to said left shoe;

a left shoe processor unit coupled to said left shoe housing;

a left shoe transceiver coupled to said left shoe housing and being communicatively coupled to said left shoe processor unit;

a right shoe;

a right shoe housing coupled to said right shoe;

a right shoe processor unit coupled to said right shoe housing;

a right shoe transceiver coupled to said right shoe housing and being communicatively coupled to said right shoe processor unit and said left shoe transceiver;

a left shoe signal assembly communicatively coupled to said left shoe processor unit for producing a left shoe alert signal when said left shoe transceiver receives a left shoe tracking signal from said right shoe transceiver;

a right shoe signal assembly communicatively coupled to said right shoe processor unit for producing a right shoe alert signal when said right shoe transceiver receives a right shoe tracking signal from said left shoe transceiver;

said left shoe signal assembly including a left shoe light assembly, said left shoe light assembly including a left shoe light emitter coupled to said left shoe housing, said left shoe light emitter being electrically coupled to said left shoe processor unit to illuminate said left shoe light emitter when said left shoe transceiver receives the left shoe tracking signal from said right shoe transceiver;

said right shoe signal assembly including a right shoe light assembly, said right shoe light assembly including a right shoe light emitter coupled to said right shoe housing, said right shoe light emitter being electrically coupled to said right shoe processor unit to illuminate said right shoe light emitter when said right shoe transceiver receives the right shoe tracking signal from said left shoe transceiver;

said left shoe light emitter projecting outwardly from said left shoe housing;

said left shoe light assembly further including a left cover coupled to said left shoe housing, said left cover extending around said left shoe light emitter;

said right shoe light emitter projecting outwardly from said right shoe housing; and said right shoe light assembly further including a right cover coupled to said right shoe housing, said right cover extending around said right shoe light emitter.

2. The system of claim 1, further comprising:

said left shoe signal assembly including a left shoe speaker coupled to said left shoe housing, said left shoe speaker producing a left shoe audio signal when said left shoe transceiver receives the left shoe tracking signal from said right shoe transceiver; and said right shoe signal assembly including a right shoe speaker coupled to said right shoe housing, said right shoe speaker producing a right shoe audio signal when said right shoe transceiver receives the right shoe tracking signal from said left shoe transceiver.

3. The system of claim 1, further comprising:

a left shoe battery electrically coupled to said left shoe processor unit for providing power to said left shoe processor unit; and a right shoe battery electrically coupled to said right shoe processor unit for providing power to said right shoe processor unit.

4. The system of claim 1, further comprising:

a left shoe actuator coupled to said left shoe housing, said left shoe actuator being communicatively coupled to said left shoe processor unit wherein said right shoe transceiver receives the right shoe alert signal from said left shoe transceiver upon activation of said left shoe actuator; and a right shoe actuator coupled to said right shoe housing, said right shoe actuator being communicatively coupled to said right shoe processor unit wherein said left shoe transceiver receives the left shoe alert signal from said right shoe transceiver upon activation of said right shoe actuator.

5. The system of claim 3, further comprising:

said left shoe housing having an opening positioned therein providing access to an interior of said left shoe housing;

said left shoe battery being positionable in said interior of said left shoe housing through said opening;

a left shoe lid couplable to said left shoe housing and being positionable to cover said opening into said left shoe housing;

said right shoe housing having an aperture positioned therein providing access to an interior of said right shoe housing;

said right shoe battery being positionable in said interior of said right shoe housing through said aperture; and a right shoe lid couplable to said right shoe housing and being positionable to cover said aperture into said right shoe housing.

6. A shoe locating system comprising:

a left shoe;

a left shoe housing coupled to said left shoe;

a left shoe processor unit coupled to said left shoe housing;

a left shoe transceiver coupled to said left shoe housing and being communicatively coupled to said left shoe processor unit;

a right shoe;

a right shoe housing coupled to said right shoe;

a right shoe processor unit coupled to said right shoe housing;

a right shoe transceiver coupled to said right shoe housing and being communicatively coupled to said right shoe processor unit and said left shoe transceiver;

a left shoe signal assembly communicatively coupled to said left shoe processor unit for producing a left shoe alert signal when said left shoe transceiver receives a left shoe tracking signal from said right shoe transceiver;

a right shoe signal assembly communicatively coupled to said right shoe processor unit for producing a right shoe alert signal when said right shoe transceiver receives a right shoe tracking signal from said left shoe transceiver;

a left shoe actuator coupled to said left shoe housing, said left shoe actuator being communicatively coupled to said left shoe processor unit wherein said right shoe transceiver receives the right shoe alert signal from said left shoe transceiver upon activation of said left shoe actuator;

a right shoe actuator coupled to said right shoe housing, said right shoe actuator being communicatively coupled to said right shoe processor unit wherein said left shoe transceiver receives the left shoe alert signal from said right shoe transceiver upon activation of said right shoe actuator;

said left shoe light assembly further including a left cover coupled to said left shoe housing, said left shoe light emitter projecting outwardly from said left shoe housing, said left cover extending around said left shoe light emitter;

said left shoe housing having a slot extending therein, said left shoe light assembly being extendable into said slot whereby said left shoe light assembly defines said left shoe actuator;

said right shoe light assembly further including a right cover coupled to said right shoe, said right shoe light emitter projecting outwardly from said right shoe housing, said right cover extending around said right shoe light emitter; and said right shoe housing having a void extending therein, said right shoe light assembly being extendable into said void whereby said right shoe light assembly defines said right shoe actuator.

7. The system of claim 1, further comprising:

said left shoe having a left shoe upper body coupled to a left shoe outsole, said left shoe housing being coupled to said left shoe outsole such that said left shoe light assembly projects outwardly from said left shoe outsole; and said right shoe having a right shoe upper body coupled to a right shoe outsole, said right shoe housing being coupled to said right shoe outsole such that said right shoe light assembly projects outwardly from said right shoe outsole.

8. A shoe locating system comprising:

a left shoe having a left shoe upper body coupled to a left shoe outsole;

a left shoe housing coupled to said left shoe, said left shoe housing having an opening positioned therein providing access to an interior of said left shoe housing, said left shoe housing having a slot extending therein;

a left shoe processor unit coupled to said left shoe housing;

a left shoe transceiver coupled to said left shoe housing and being communicatively coupled to said left shoe processor unit;

a right shoe having a right shoe upper body coupled to a right shoe outsole;

a right shoe housing coupled to said right shoe, said right shoe housing having an aperture positioned therein providing access to an interior of said right shoe housing, said right shoe housing having a void extending therein;

a right shoe processor unit coupled to said right shoe housing;

a right shoe transceiver coupled to said right shoe housing and being communicatively coupled to said right shoe processor unit and said left shoe transceiver;

a left shoe signal assembly communicatively coupled to said left shoe processor unit for producing a left shoe alert signal when said left shoe transceiver receives a left shoe tracking signal from said right shoe transceiver;

a right shoe signal assembly communicatively coupled to said right shoe processor unit for producing a right shoe alert signal when said right shoe transceiver receives a right shoe tracking signal from said left shoe transceiver;

said left shoe signal assembly including a left shoe speaker coupled to said left shoe housing, said left shoe speaker producing a left shoe audio signal when said left shoe transceiver receives the left shoe tracking signal from said right shoe transceiver;

said right shoe signal assembly including a right shoe speaker coupled to said right shoe housing, said right shoe speaker producing a right shoe audio signal when said right shoe transceiver receives the right shoe tracking signal from said left shoe transceiver;

a left shoe actuator coupled to said left shoe housing, said left shoe actuator being communicatively coupled to said left shoe processor unit wherein said right shoe transceiver receives the right shoe alert signal from said left shoe transceiver upon activation of said left shoe actuator;

a right shoe actuator coupled to said right shoe housing, said right shoe actuator being communicatively coupled to said right shoe processor unit wherein said left shoe transceiver receives the left shoe alert signal from said right shoe transceiver upon activation of said right shoe actuator;

said left shoe signal assembly including a left shoe light assembly, said left shoe light assembly including a left shoe light emitter and a left cover, said left shoe light emitter being coupled to said left shoe housing, said left shoe light emitter being electrically coupled to said left shoe processor unit to illuminate said left shoe light emitter when said left shoe transceiver receives the left shoe tracking signal from said right shoe transceiver, said left shoe light emitter projecting outwardly from said left shoe housing, said left cover extending around said left shoe light emitter, said left shoe light assembly being extendable into said slot whereby said left shoe light assembly defines said left shoe actuator, said left shoe housing being coupled to said left shoe outsole such that said left shoe light assembly projects outwardly from said left shoe outsole;

said right shoe signal assembly including a right shoe light assembly, said right shoe light assembly including a right shoe light emitter and a right cover, said right shoe light emitter being coupled to said right shoe housing, said right shoe light emitter being electrically coupled to said right shoe processor unit to illuminate said right shoe light emitter when said right shoe transceiver receives the right shoe tracking signal from said left shoe transceiver, said right shoe light emitter projecting outwardly from said right shoe housing, said right cover extending around said right shoe light emitter, said right shoe light assembly being extendable into said void whereby said right shoe light assembly defines said right shoe actuator, said right shoe housing being coupled to said right shoe outsole such that said right shoe light assembly projects outwardly from said right shoe outsole;

a left shoe battery electrically coupled to said left shoe processor unit for providing power to said left shoe processor unit, said left shoe battery being positionable in said interior of said left shoe housing through said opening;

a right shoe battery electrically coupled to said right shoe processor unit for providing power to said right shoe processor unit, said right shoe battery being positionable in said interior of said right shoe housing through said aperture;

a left shoe lid couplable to said left shoe housing and being positionable to cover said opening into said left shoe housing; and a right shoe lid couplable to said right shoe housing and being positionable to cover said aperture into said right shoe housing.

* * * * *